United States Patent [19]

Fetters

[11] Patent Number: 4,483,245

[45] Date of Patent: Nov. 20, 1984

[54] BALING APPARATUS

[76] Inventor: Wayne A. Fetters, P.O. Box 841, Canby, Oreg. 97013

[21] Appl. No.: 439,856

[22] Filed: Nov. 8, 1982

[51] Int. Cl.[3] ..... B65B 13/20

[52] U.S. Cl. ..... 100/7; 100/3; 100/26; 100/100; 100/218; 100/233; 100/264; 294/106

[58] Field of Search ..... 100/100, 7, 3, 26, 233, 100/234, 211, 212, 215, 218, 264; 53/528, 529, 589; 294/86 R, 106, 111

[56] References Cited

U.S. PATENT DOCUMENTS

| | | | |
|---|---|---|---|
| 1,464,332 | 8/1923 | Pease | 100/7 X |
| 3,427,958 | 2/1969 | Glasson | 100/7 |
| 3,427,959 | 2/1969 | Keil | 100/3 X |
| 3,554,119 | 1/1971 | Schoellhorn | 100/233 X |
| 3,746,385 | 7/1973 | Mitchell | 294/111 X |
| 3,782,567 | 1/1974 | Likas | 294/106 X |
| 3,897,969 | 8/1975 | Dike | 294/106 X |
| 3,939,762 | 2/1976 | Smitherman | 100/3 X |
| 4,141,289 | 2/1979 | Blagov | 100/3 X |

FOREIGN PATENT DOCUMENTS

| | | | |
|---|---|---|---|
| 1358472 | 7/1974 | United Kingdom | 100/212 |
| 219307 | 3/1969 | U.S.S.R. | 100/233 |

*Primary Examiner*—Billy J. Wilhite

[57] ABSTRACT

A base frame supports pairs of parallel compressing arms having a pivoted depending support on an upper extension. These arms are operated between open and bale forming positions by fluid operated cylinders. An article holding cartridge has upstanding ribs arranged to confine articles therebetween for baling. The ribs are spaced such that upon moving the loaded cartridge into place on a cross conveyor, the compressing arms thread through the ribs and compress the articles. The upper extension has powered lifting and lowering means for operation of the compressing arms in a baling sequence and also to open the arms rearwardly for ejecting the bale. Upper straps are associated with the compressing arms to compress the top portion of the bale, and banding mechanism is supported on the frame for applying bands around the bale. The base frame is supported on a wheeled chassis and has longitudinal adjustment on the chassis for positioning between a rear baling position and a forward road traveling position.

15 Claims, 11 Drawing Figures

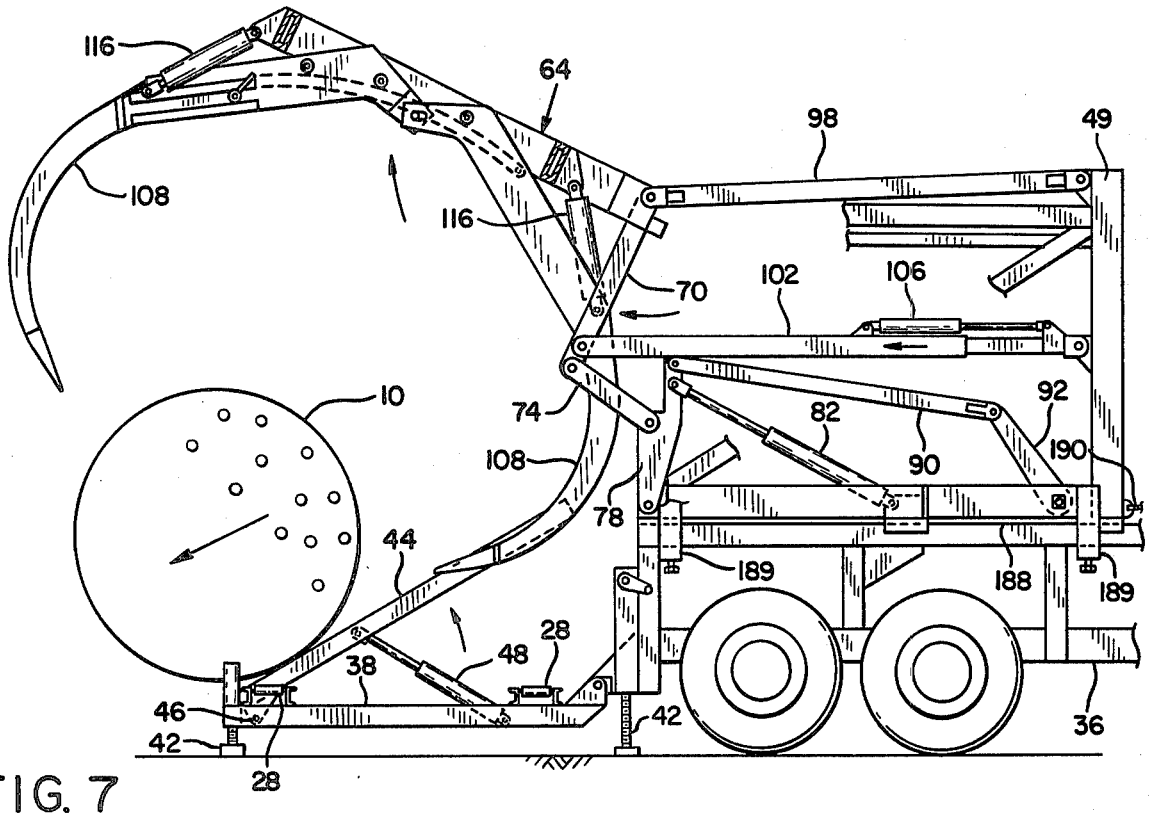
FIG. 7
FIG. 8
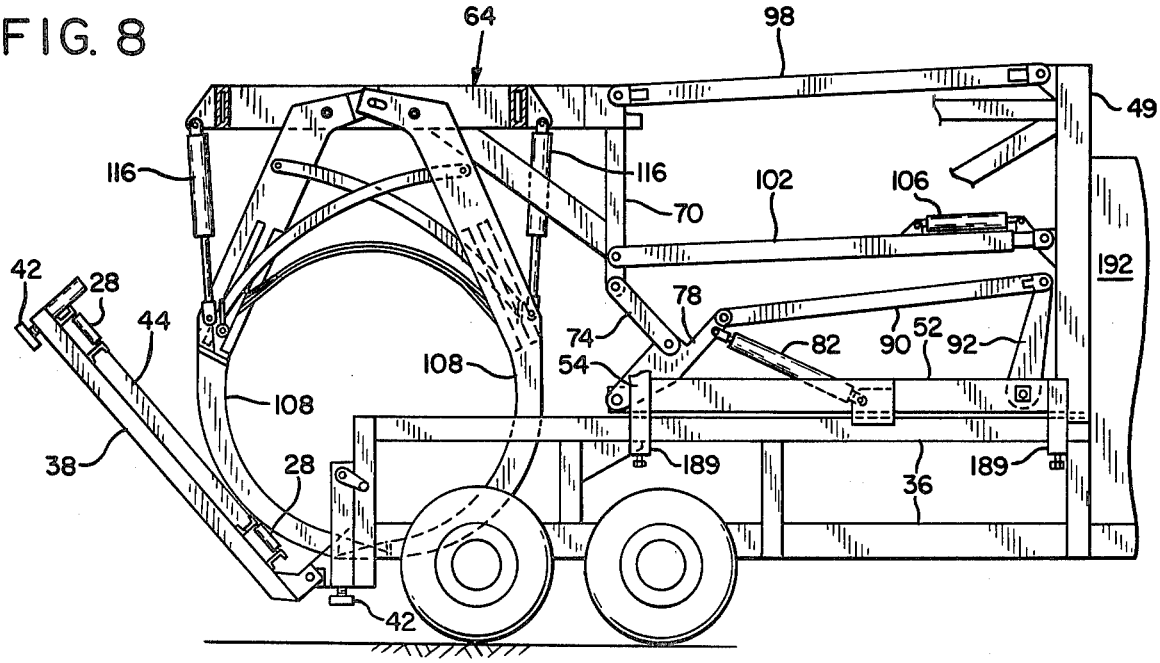

FIG. 10
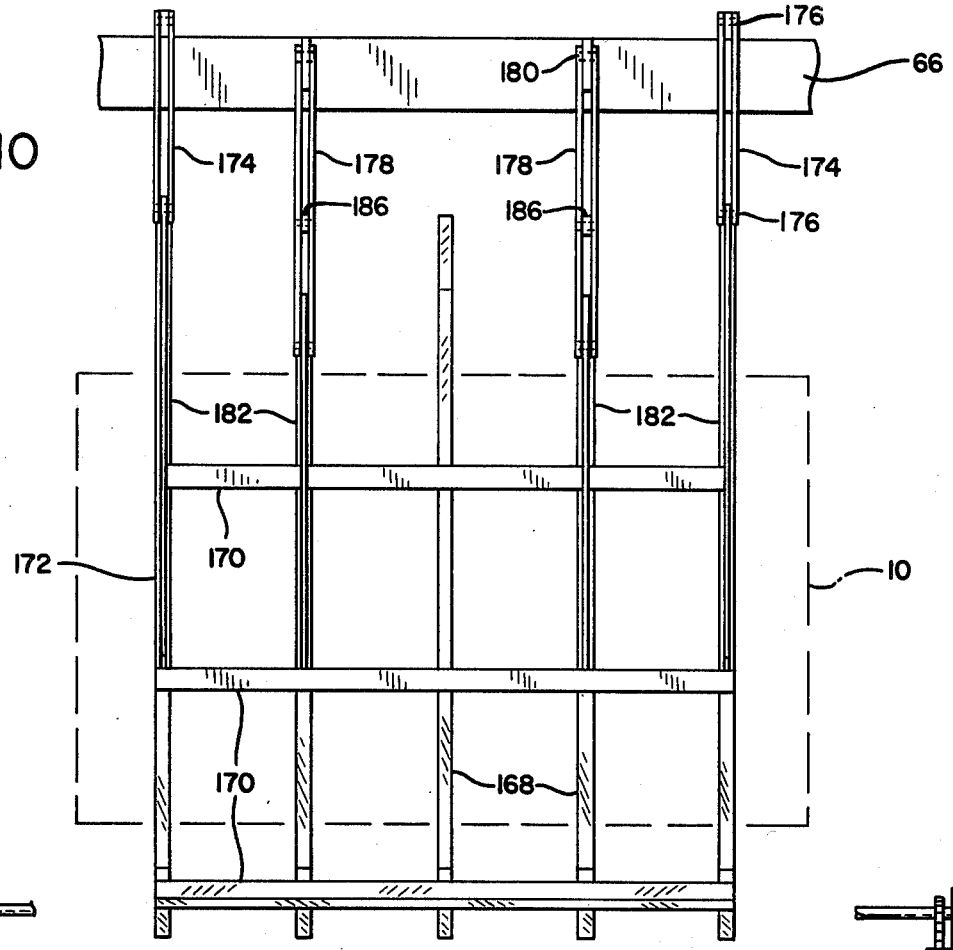
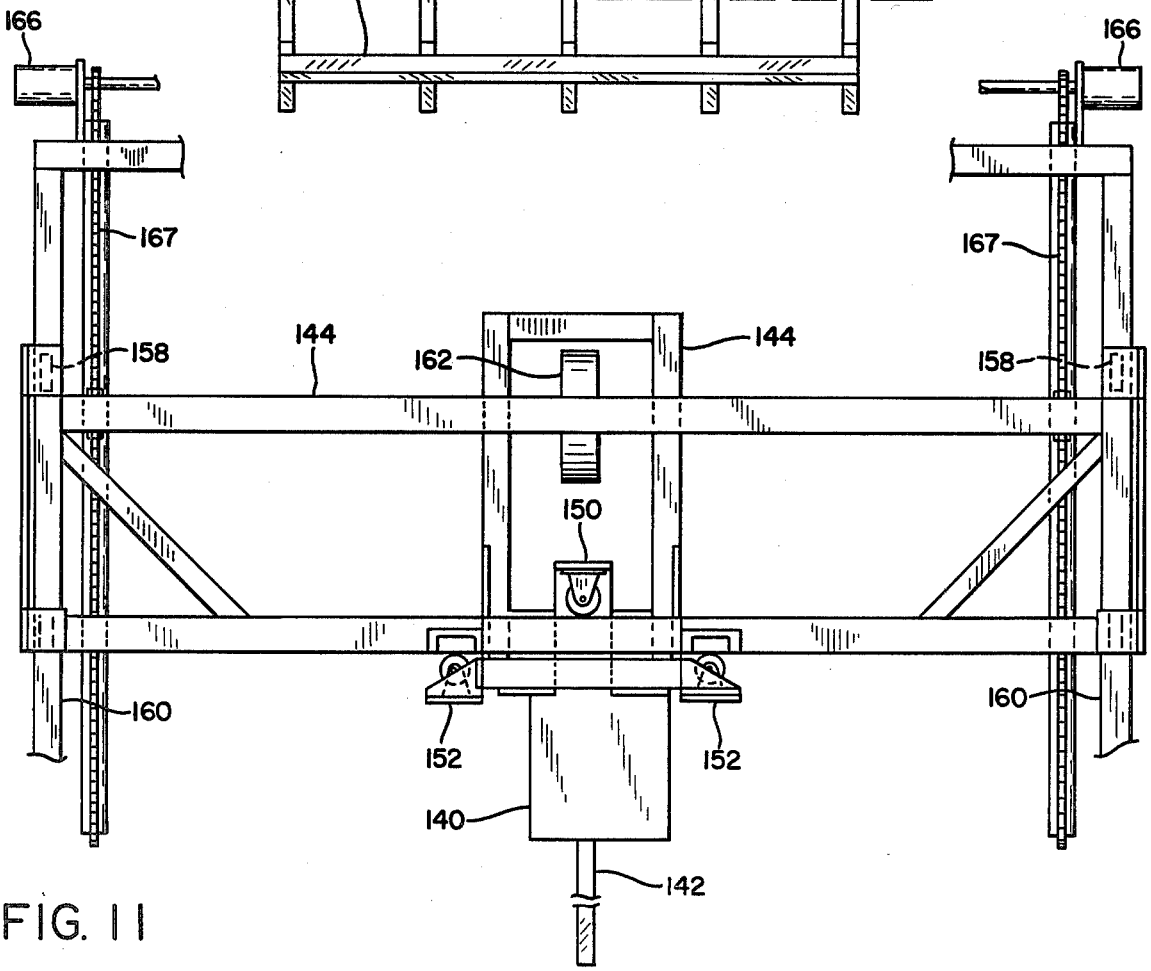
FIG. 11

BALING APPARATUS

BACKGROUND OF THE INVENTION

This invention relates to new and useful improvements in baling apparatuses and has one particular and important use as a Christmas tree baler.

The harvesting of Christmas trees is carried on at a large scale and in a short time period, and since the growing areas of such trees are localized, the trees are shipped in mass from such localized areas throughout the United States and the world. Some growers ship trees in loose form but in order to conserve on space and provide ease in handling, the trees have been tied in bundles. Some growers of trees manually bundle the trees but such a procedure is time consuming and expensive. Also, growers have moved cut trees with lift trucks, grapples, or the like for loading and handling but such procedures, although cutting down on handling time, also causes damage to the trees. Still another disadvantage of previous procedures is that the trees when shipped individually are prone to theft and even when bundled, the bundles cannot be tight enough to avoid trees from being stolen by removing individual trees from the bundle.

SUMMARY OF THE INVENTION

According to the present invention and forming a primary objective thereof, a process and an apparatus are provided which facilitate mass handling of cut Christmas trees and at the same time the trees are compressed without material damage into bundles that are easily handled, take minimum space in transportation, and minimize theft of individual trees.

A more particular object is to provide a baling apparatus that includes in combination a portable cartridge which can be trucked to the cutting site and which has upstanding ribs between which trees are stacked, the baling apparatus including means to receive the cartridge and compressing arms that thread through the ribs for compressing the stacked trees, thus providing a process and apparatus whereby trees can be cut at the field, placed in the cartridge at the cutting site, transported to a baling apparatus in the cartridge, and compressed into a compact bale.

Another object is to provide a combination baling apparatus and conveyor wherein the loaded cartridges are transported transversely into the baling apparatus, and after the trees are compressed and prior to ejection as a bale, said cartridges are carried away from the baling apparatus to allow room for completion of the baling process.

Another object of the invention is to provide baling apparatus of the type described having a novel ejecting means arranged to roll the compressed bale of trees rearwardly out of the apparatus upon completion of the bale.

Still another object of the invention is to provide baling apparatus of the type described employing a novel combination of compressing arms and means associated with the arms for forming a substantially circular bundle.

Yet another object is to provide baling apparatus of the type described utilizing a novel arrangement of conventional powered strapping means in combination therewith for tying the trees in bales.

In carrying out the objectives of the invention, a cartridge is employed in the combination which is in pallet form and can be transported by lift truck or other mechanism from the tree site to the baling site. The cartridges comprise a base and pairs of longitudinally spaced upstanding cupped ribs. Cut trees are transported to the baling site on the cartridges and conveyor means on the baling apparatus is arranged to position the cartridge in the apparatus for compression of the loose trees in the cartridge into bales. The apparatus employs opposed pairs of compression arms selectively spaced so as to thread through the ribs of the cartridge. The baling apparatus also employs support means for the arms which is capable of raising and lowering the arms in the baling process and also for tilting the arms for ejecting the bundle of trees rearwardly after the cartridge has been carried away on the other side by the conveyor. The apparatus also includes powered strapping means for tying the trees in bundles in the baling process.

The invention will be better understood and additional objects and advantages will become apparent from the following description taken in connection with the accompanying drawings.

BRIEF DESCRIPTION OF THE DRAWINGS

FIG. 7 is a view similar to FIG. 4, in reduced scale, showing an operative condition of the baling apparatus for ejecting a completed bale;

FIG. 8 is an elevational view taken similar to FIG. 4, in reduced scale, and showing the baling apparatus in compacted condition for transportation;

FIG. 10 is an end elevational view of a portion of the strapping mechanism, this view being taken on the line 10—10 of FIG. 9; and FIG. 11 is a fragmentary top plan view taken on the line 11—11 of FIG. 9 and also showing a portion of the strapping mechanism.

DETAILED DESCRIPTION OF A PREFERRED EMBODIMENT

Figure 2:
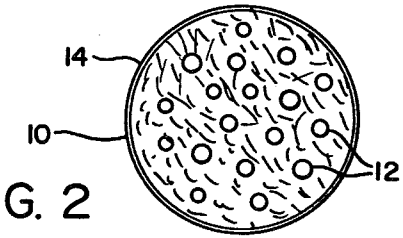
FIG. 2 is an end view of a bale of trees formed by the process and apparatus of the invention.

Referring first to FIG. 2, an end view of a compressed and tied bale 10 of trees is shown, comprising trees 12 stacked in parallel relation and held in substantially circular bale condition by encircling bands 14 applied by the present apparatus. In order to form a compact bale, the tree butts are alternately placed in opposite directions.

Figure 3:
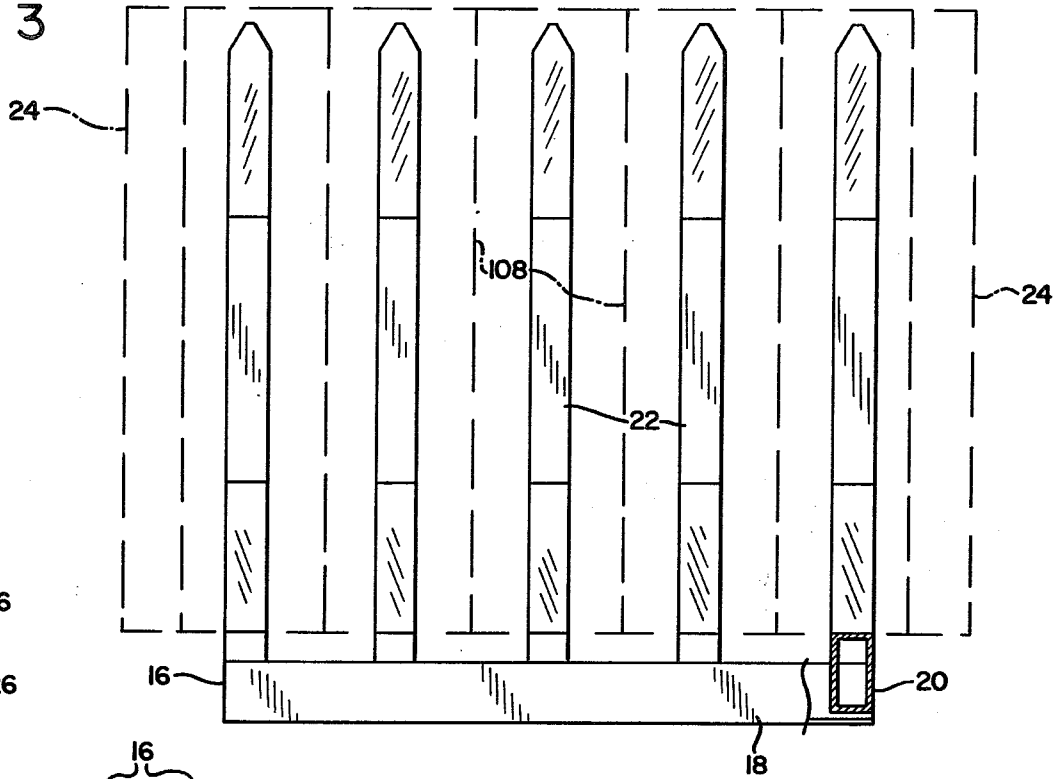
FIG. 3 is an enlarged side elevational view of a cartridge of the invention on which cut trees are carried to the baling apparatus, this view including broken lines to illustrate a loose load of trees stacked therein and also the position that will be occupied by compression arms of the apparatus.
Figure 1:
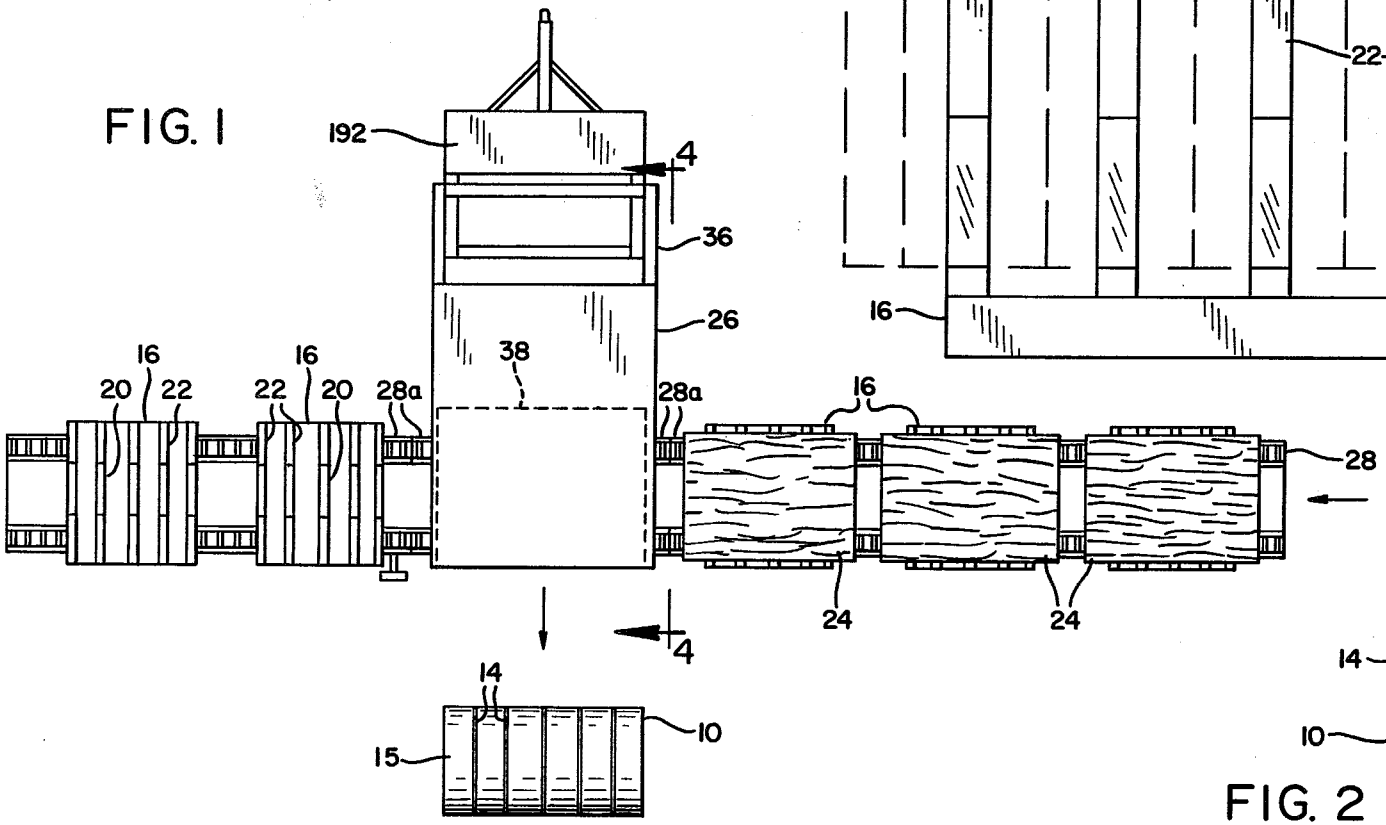
FIG. 1 is a plan view, somewhat diagrammatic, of the baling apparatus of the invention including cartridges for a load of trees to be baled as well as the transverse conveyor which carries the full cartridges into the baling apparatus and the empty cartridges out the other side, this view also showing a completed bale of trees as ejected from the rear of the apparatus.
Figure 4:
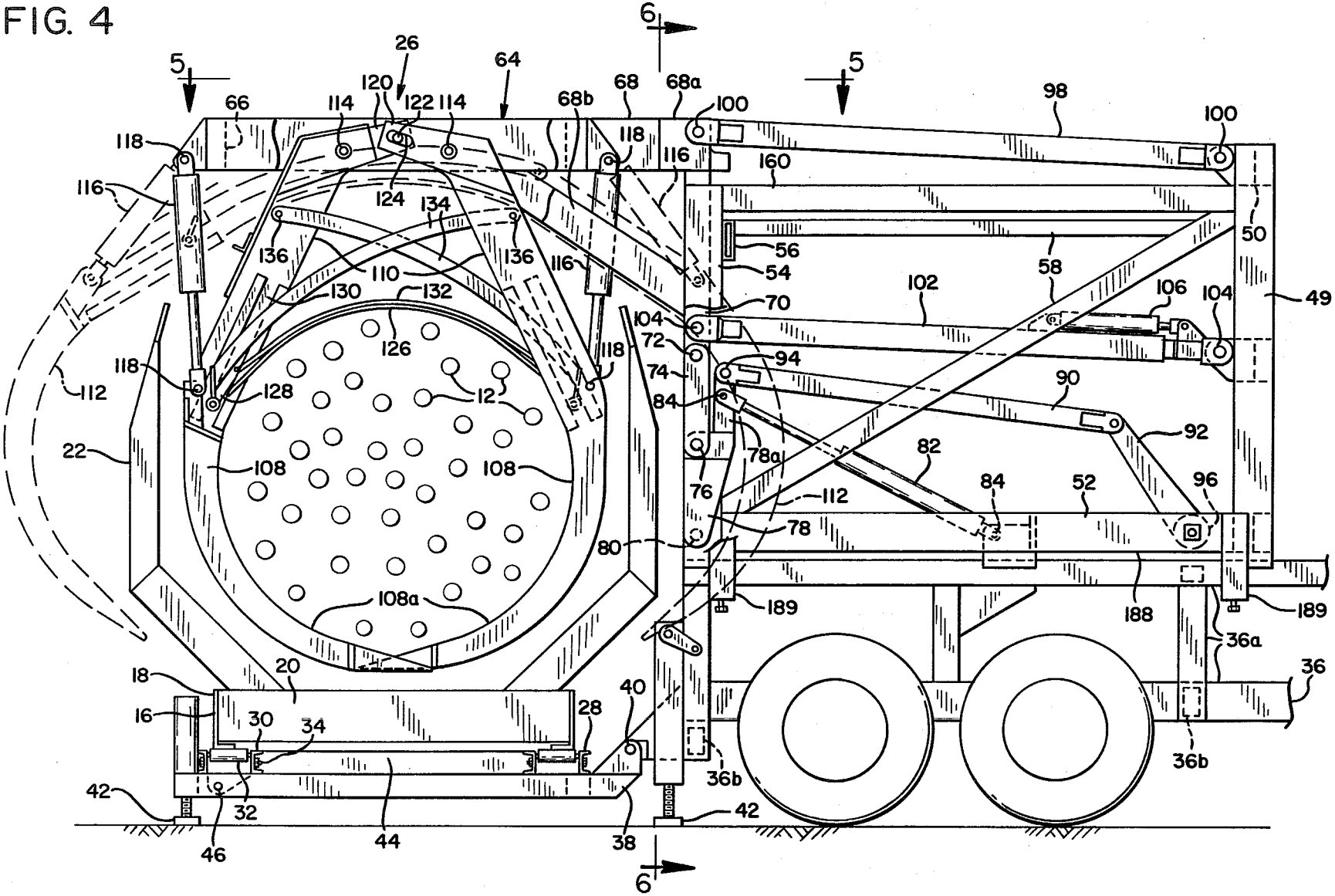
FIG. 4 is a side elevational view of the baling apparatus, this view being taken on the line 4—4 of FIG. 1 and showing a cartridge in place in the machine with a charge of trees being compressed into a bale, a near side of the frame being broken away for clarity.
Figure 5:
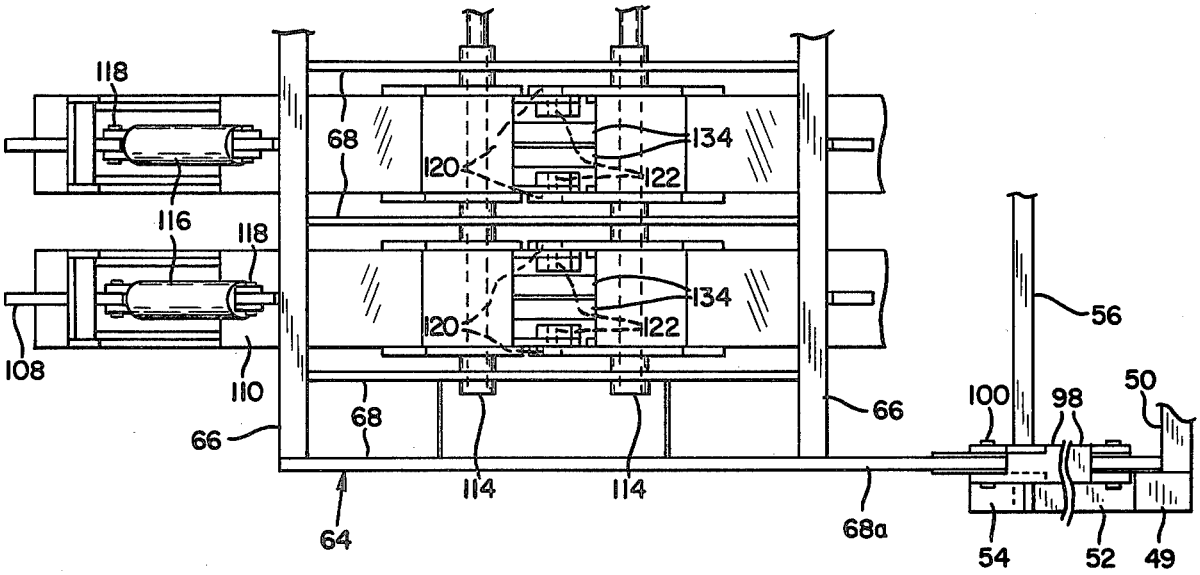
FIG. 5 is a fragmentary top plan view taken on the line 5—5 of FIG. 4.
Figure 6:
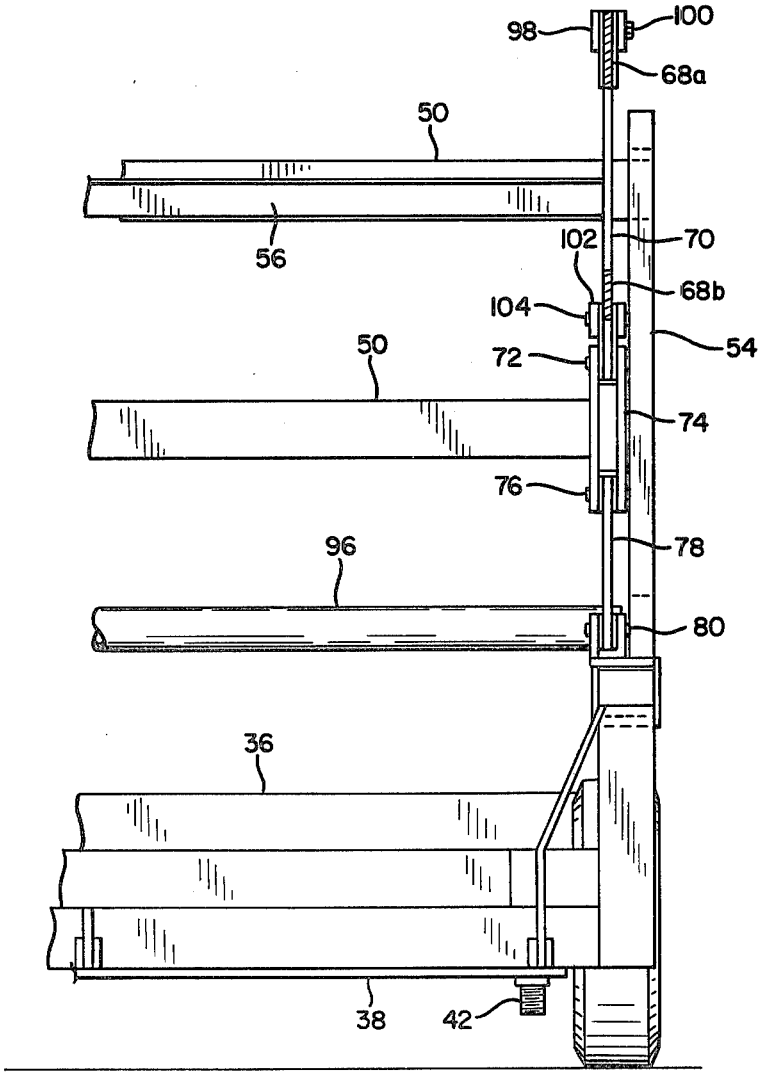
FIG. 6 is a fragmentary end elevational view taken on the line 6—6 of FIG. 4.

An important element of the invention comprises cartridges 16, FIGS. 1, 3 and 4, comprising longitudinal side frame pieces 18 interconnected by a plurality of cross pieces 20 each having integral upright cupped ribs 22 between which trees are arranged to be stacked for transportation with the cartridge from the field to the baling apparatus. The phantom outline 24 in FIG. 3 illustrates the approximate size of a load of loose trees as stacked in the cartridge at the tree cutting site.

Referring to FIG. 1, the baling apparatus, designated generally by the numeral 26, is associated with a transverse conveyor 28 which receives cartridges 16 with trees stacked therein on one side and which is arranged to feed the cartridges transversely into the baler. The conveyor also is arranged to discharge the empty cartridges out the other side. As will be seen, completed bales are ejected rearwardly from the apparatus after its cartridge has been moved laterally out of the apparatus. With reference also to FIG. 4, the conveyor 28 comprises longitudinal frame pieces 30 supporting rollers 32 on which the cartridges are movably supported. Conveyor 28 is formed in disconnectable sections 28*a* suitably connected together for assembly and disassembly such as by bolted connecting plates 34, FIG. 4.

In a preferred structure, the baling apparatus is supported on a lower wheeled main frame 36 having side frame pieces 36*a* and transverse connecting pieces 36*b*. The rear portion of the frame 36 is open between the sides for a reason to be described. The main frame 36 supports a rear bottom platform 38 on which the conveyor 28 is mounted. This platform has pivot connection 40 at its front with the frame 36 and has vertically adjustable feet members 42 for support on the ground. Frame portion 38 can be swung upwardly when it is desired to transport the apparatus, such a position being shown in FIG. 8.

Frame portion 38 supports an ejecting mechanism comprising an arm 44, best seen in FIG. 7, having a pivot connection 46 at the rear of the frame portion 38. A fluid operated cylinder 48 is connected between the frame portion 38 and the arm 44. Ejecting arm 44 in its rest position fits down in suitable slots in the conveyor 28 so that in its lowered position it is below the top of rollers 32. As apparent in FIG. 7, actuation of the fluid operated cylinder 48 raises the arm 44 to eject a bale 10 from the apparatus.

With particular reference to FIGS. 4 through 8, main frame 36 supports a secondary frame comprising rigid upright frame members 49 reinforced by cross members 50. Frame members 49 are also secured to bottom longitudinal frame members 52 located at the sides and in turn connected to front upright frame members 54 having reinforcing cross members 56. Suitable reinforcing members 58 are provided as necessary.

A compression arm supporting frame 64 at the rear of the secondary frame has rigid cross members 66 and rigid longitudinal connecting members 68. The two outermost members 68 have front extensions 68*a* which have rigid securement to depending links 70. The lower ends of links 70 have pivot connections 72 with the upper end of connecting links 74. The lower ends of links 74 have pivot connections 76 with the upper ends of toggle links 78 having bottom pivot connections 80 with the frame members 52. Toggle links 78 have upright extensions 78*a* pivotally connected at an upper portion 84 thereof to fluid operated cylinders 82 in turn pivotally connected at 84 to a forward point of the frame 52. An equalizing link assembly is provided between the two side toggle links 78 and comprises pairs of pivotally connected links 90 and 92, the links 90 having a pivot connection 94 to the upper end of the toggle links and the two side links 92 having integral connection to a cross torque tube 96. The link assemblies 90 and 92 and torque tube 96 insure equal and unitary rotation of the two toggle links 78. Upper longitudinal links 98 have opposite pivot connections 100 between arm supporting frame 64 and rear frame members 49. Expandable links 102, one on each side, have end pivot connections 104 between a lower portion of links 70 and rear frame portions 49 and have length expansion and contraction by means of fluid operated cylinders 106. As will be more apparent hereinafter, fluid operated cylinders 82 are arranged to either hold the toggle link assemblies 78 in an upright position or to pivot such assemblies forwardly, the latter position of the toggle links lowering the links 70 and the arm supporting frame 64 to a lower plane. Fluid operated cylinders 106 are arranged in the contracted condition thereof to hold the links 70 in a vertical position as shown in FIG. 4 wherein the frame 68 is substantially horizontal, and in the expanded condition thereof to tilt the links 70 for tilting the arm supporting frame 64 as shown in FIG. 7.

The inner longitudinal connecting members 68 of the arm supporting frame 64 pivotally support opposed pairs of compression arms 108 having bottom curved portions 108*a* and upper channel-shaped reinforced portions 110. These arms have pivot connections 114 between pairs of the connecting members 68 and are pivoted by fluid operated cylinders 116 having opposite pivot connections 118 with an intermediate portion of the arms and the supporting frame 64. The cylinders are arranged to move the arms between a closed position as shown in full lines in FIG. 4 or an open position as shown in phantom lines in this same figure. Compression arms 108 have inwardly turned top lever ends 120 which have overlapping engagement and pivotally receive cam followers 122 which operate in elongated slots 124 in the ends of the levers 120 and which insure that the arms operate in symmetrical rotation.

Upper bale confining means is associated with each pair of arms comprising a band 126 approximately the width of arm portions 110 and having end cam followers 128 secured thereto which operate in cam slots 130 in the upper reinforced portions 110 of the arms 108. A cable 132 extends over the top of the band 126 and has its opposite ends also connected securely to the cam followers 128. This cable provides tensioned reinforcement on the top of the band 126. Movement of the cam followers 128 in the cam slots 130 is accomplished by a pair of links 134 having one end secured to respective cam followers 128 and their opposite ends pivotally connected to the opposite arms by pivot connections 136. Links 134, as well as the cam slots 130, are connected to opposite side walls of the channel-shaped portions 110 of the arms 108 for clearance. As the arms open, the links 134 pull the cam followers 128 upwardly in their slots to raise the cable 132 and band 126. When the arms close, these links push the ends of the bands as well as the reinforcing cable 132 downwardly to compress the upper portion of the bale and make it substantially circular in concentric relation to the compression portion 108*a* of the arms 108.

The number of pairs of opposed arm assemblies 108 may vary depending upon the length of the bale. For use with a cartridge as shown in FIG. 3 which employs five ribs along each side, it is preferred that six sets of arms 108 be employed, namely, arms thread between the ribs 22 and also pass along the ends of the cartridge. Any number of ribs and a proportionate number of compression arms may be used.

Figure 9:
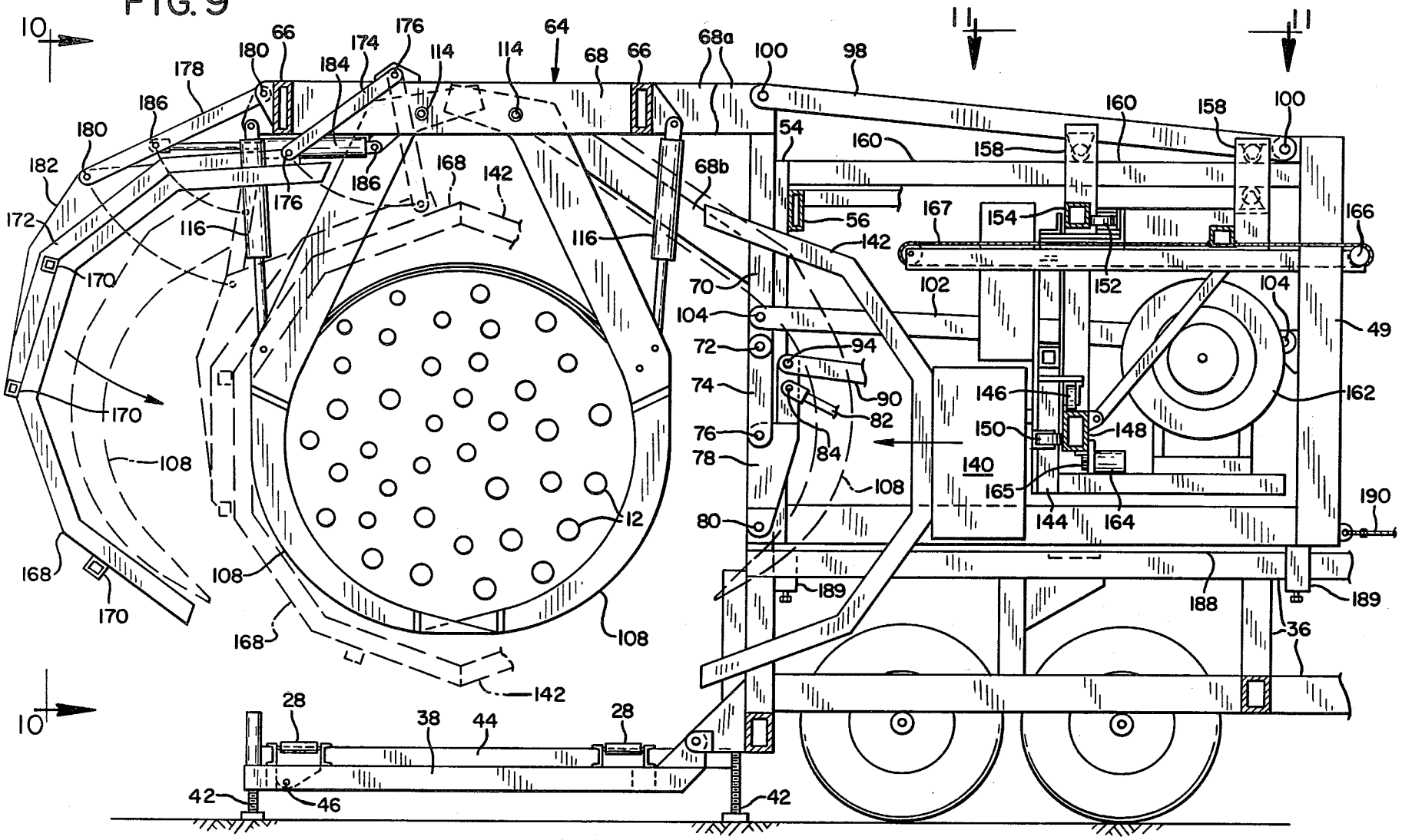
FIG. 9 is an elevational view also taken similar to FIG. 4 but showing strapping means in combination with the baling apparatus for tying a bale of trees, a near side of the frame being broken away for clarity.

The apparatus employs strapping means for applying the straps 14 around the bale. Such strapping mechanism is shown in FIGS. 9, 10 and 11 and employs a conventional strapping mechanism 140 with the usual upright cup-shaped strap feed track 142. Strapping mechanism 140 is supported on a frame 144 having wheel support 146 on a lower transverse frame member 148 integral with suitable portions of the secondary frame, such as with frame members 152 or 158. Upright and guided support of the strapping mechanism 140 are provided by a lower wheel assembly 150 engaging a forward surface of frame member 148 and upper wheel assemblies 152 engaging the rear surface of a transverse frame member 154 integral with the secondary frame similar to frame member 148. Wheel assemblies 146, 150 and 152 provide transverse adjustment movement of the strapping mechanism 140.

The strapping mechanism also has longitudinal movement by means of upper trolley assemblies 158 integral with the strapping mechanism frame 144 and operating on tracks 160 secured to the secondary frame members 49 and 54. Such frame also supports a strap supply casing 162 for the strapping head 140.

Driving movements of the strapping mechanism in a transverse direction are supplied by suitable means such as one or more fluid operated motors 164, FIG. 9, on the frame 144 and having a rack and gear drive connection 165 with the frame member 148. Driving movements of the strapping mechanism for longitudinal movement are supplied by one or more fluid operated motors 166, FIG. 11, on the frame 49 and operating a chain drive 167 secured to the frame 144.

Strap feed track 142 is associated with opposed cup-shaped receiving tracks 168 mounted on the compression arm supporting frame 64 on the side opposite from the feed track 142. One of the receiving tracks 168 is provided between each set of compression arms 108. This series of receiving tracks is connected integrally by cross frame members 170 into an integral structure. Each receiving track has reinforcing outer channel members 172 integral with the cross frame members 170, and support of this receiving track assembly is provided partially by links 174 at opposite sides of the frame 64 and having opposite pivot connections 176 between an upper end portion of reinforcing channel members 172 and the arm supporting frame 64. The remainder of the support for the track assembly 168 is provided by links 178 also at opposite sides of the frame 64 and having pivot connections 180 at their opposite ends between ears 182 on one of the reinforcing channel members 172 and the arm supporting frame 64. Fluid operated cylinders 184 have opposite pivot connections 186 between an intermediate portion of the links 178 and the arm supporting frame 64. The links 178 are longer than the links 174 and with the support end of the links 178 being outwardly of the support end of the links 174, movement of the links around their pivot supports 176 and 180 by means of the fluid operated cylinder 184 moves the assembly of strap receiving tracks 168 from an outer upper position to a lower inner position as shown respectively in full and broken lines in FIG. 9. The assembly of tracks 168 is precisely located such that when it is in its lower inner position and the feed track 142 is moved inwardly, the ends of the receiving tracks are in communication as shown in broken lines in FIG. 9. Strapping is fed from the feed track 142 through a receiving track 168 and back into the feed track and strapping head 140 for securing and cutting in a conventional manner.

OPERATION

In the operation of the present process and apparatus, the cartridges 16 are transported to the cutting site, as by lift trucks, and loaded. The trees are stacked in parallel relation preferably with the butt ends thereof disposed in alternate directions. The cartridges are then transported to the baling site and placed on the infeed side of the conveyor 28. Prior to moving a cartridge into the baling apparatus, fluid operated cylinders 82 are expanded to move the toggle links 178 to their upright position. This holds the arm supporting frame 64 in its upper position. Also, fluid operated cylinders 116 are retracted to open the arms to their broken line position shown in FIG. 4. Furthermore, the strapping head 140 is retracted as is the receiving track assembly 168. The cartridge is then moved in to a selected position such that the arms 108 are aligned with the spaces between the ribs 22 of the cartridge. Fluid operated cylinders 82 are then retracted to pivot the toggle links 78 in a clockwise direction, FIG. 4, to lower the entire assembly of arm supporting frame 64 and the supporting links 70 and 74. The cylinders 116 are then expanded to close the arms 108 to compress the bale. Such a compressed bale is shown in FIGS. 4 and 9.

With the arms 108 closed, the fluid operated cylinders 82 are expanded to return the toggle links 78 to their vertical position and thus raise the arm supporting frame 64 together with the load of trees in the arms. This separates the trees from the cartridge and the empty cartridge can then be moved out of the baling apparatus on the conveyor 28.

Next, the outer strap receiving track assembly 168 is moved inwardly, by retracting operation of the cylinder 184, to the broken line position shown in FIG. 9. The strapping head is then moved laterally into a position such that feed track 142 is aligned with a first of the tracks 168. The strapping head is then moved toward the bale to provide engagement of track 142 with the said first track 168. Thereupon, the strapping mechanism is actuated to feed a strap around the bale through the first track 168 and into track 142 and the mechanism for tying. The strapping mechanism is then retracted and advanced so as to be progressively associated with one of the receiving tracks 168 at a time to feed each of the latter with a strap and provide multiple strapping of a bale, such strapping occurring between the arms 108 and thus in the area previously occupied by the ribs 22 of the cartridge 16.

When the strapping has been completed with all of the receiving tracks 168, the strap receiving assembly 168 as well as the strapping head 140 are retracted.

Thereupon, the arms 108 are opened by the cylinders 116 and the arm supporting frame 64 tilted upwardly by means of the cylinder 106. This position of the parts is shown in FIG. 7. This will drop the bale 10 on the conveyor 28 whereupon the ejecting cylinder 48 is expanded to raise the ejecting arm assembly 44 and roll the bale rearwardly out of the baling apparatus.

It is preferred that the secondary frame including members 49, 52 and others have a sliding or other longitudinally movable support on the main frame 36 whereby this secondary frame can be moved fbrwardly on the frame 36 to a position shown in FIG. 8. Such a support comprises slidable seating engagement 188 of longitudinal frame members 52 with upper longitudinal frame members 36*a* and guided support by depending guide and releasable clamp means 189. Movement of the secondary frame may be achieved by a conventional cable and winch assembly 190, FIG. 7, and the forward position thereof comprises a transporting position of the baling apparatus to provide a better center of gravity of the apparatus over the wheels of the frame. This forward positioning of the entire secondary frame is permitted since the main frame 36 is open at the rear portion thereof. In the traveling condition, the rear platform 38 is pivoted to an upwardly inclined position behind the compressing arm assembly and tied in such position. In such condition of the apparatus, the arms 108 are moved to their closed position.

The apparatus preferably carries its own power for the fluid operated cylinders, such as a diesel engine 192, FIGS. 1 and 8, supported on the frame 36.

According to the invention, a mass baling of Christmas trees can be accomplished with minimum damage to the trees. That is, the trees can be carefully loaded on the cartridges 16 and the cartridges transported to the baling site by powered lift equipment. By such arrangement, the trees are not themselves engaged by mechanical means. The trees when stacked with their butt ends in alternate directions form an even and compact bale and can be compressed at least 50 percent by the arms 108 without material damage. Thus a bale is provided which takes up minimum space for shipment and handling and due to the high total value of a bale and the compactness thereof, shipments thereof can be closely monitored to avoid theft. Also due to the compactness thereof, theft of individual trees is minimized. The trees preferably are baled with an outer wrapping such as paper or plastic. This wrapping layer is laid in the cartridge before loading the trees in the cartridge and then folded over the top of the stacked trees prior to movement of the cartridge into the machine. The paper is bound in place by the straps 14 to provide protection for the trees against dirt and also to provide better compaction of the trees. A paper cover is designated by the numeral 15 in FIG. 1.

It is to be understood that the form of my invention herein shown and described is to be taken as a preferred example of the same and that various changes in the shape, size and arrangement of parts may be resorted to without departing from the spirit of my invention, or the scope of the subjoined claims.

Having thus described my invention, I claim:

1. Apparatus for compressing elongated articles into bales comprising (a) a base frame having forward and rearward ends and opposite sides, (b) an upper extension on said base frame, (c) at least two pairs of opposed arms supported on said upper extension in pivotal depending spaced relation with said pairs of arms being substantially parallel, (d) said arms in each pair being aligned from front to rear whereby to provide side openings into the area therebetween, (e) means connected to said arms arranged to move opposed arms between open article receiving position and closed article baling position, (f) an article holding cartridge having pairs of upstanding spaced ribs arranged to confine articles therebetween for baling, (g) said opposed pairs of ribs being substantially parallel with each other and spaced so that said arms can move therebetween whereby articles on said cartridge can be compressed into a bale by movement of said arms to said baling position through the area between said ribs, (h) and a transversely extending conveyor associated with said frame for moving said cartridges from the side into a baling position for articles in the area between said arms.

2. The apparatus of claim 1 including means on said frame connected to said upper extension arranged to raise said extension and said arms between a lowered baling position and an upper cartridge inserting and removing position.

3. The apparatus of claim 2 wherein said upper extension has a pivot connection at one of its ends to said frame, and means on said frame for pivoting said upper extension to a first position comprising the baling position of said arms and a tilted position allowing the discharge of a bale rearwardly past the ends of said arms in the open position thereof.

4. The apparatus of claim 2 wherein said upper extension has a pivot connection at one of its ends to said frame, and means on said frame for pivoting said upper extension to a first position comprising the baling position of said arms and a tilted position allowing the discharge of a bale rearwardly past the ends of said arms in the open position thereof, and ejecting means for rolling a bale rearwardly past the ends of said arms.

5. The apparatus of claim 1 including means on said frame connected to said upper extension arranged to raise said extension and said arms between a lowered baling position and an upper cartridge inserting and removing position, said upper extension having a pivot connection at one of its ends to said frame, means on said frame for pivoting said upper extension to a first position comprising the baling position of said arms and a tilted position allowing the discharge of a bale rearwardly past the ends of said arms in the open position thereof, and ejecting means associated with said conveyor for rolling the bale rearwardly of said conveyor past the ends of said arms.

6. The apparatus of claim 5 wherein said conveyor is also arranged to carry emptied cartridges away from said baling position.

7. The apparatus of claim 1 including strap means on said arms operable with said arms for compressing an upper portion of a bale.

8. The apparatus of claim 7 wherein said strap means has slidable support on at least one of its ends on said arms for movement relative to said arms as the latter open and close.

9. The apparatus of claim 1 including banding means on said frame arranged to apply banding around a bale compressed by said arms.

10. The apparatus of claim 1 including banding means on said frame arranged to apply banding around a bale compressed by said arms, said banding means operating in the space between said arms after removal of a cartridge by said conveyor.

11. The apparatus of claim 1 including a wheeled support for said frame, said upper extension projecting rearwardly from said frame, and means for moving said frame forward on said support relative to said wheels for road travel.

12. Apparatus for compressing elongated articles into bales comprising (a) a base frame having forward and rearward ends and opposite sides, (b) an upper extension pivotally connected at one of its ends to said frame, (c) at least two pairs of front to rear opposed arms supported on said upper extension in pivotal depending spaced relation with said pair of arms being substantially parallel, (d) means connected to said arms arranged to move opposed arms between open article receiving position and closed article baling position, (e) means on said frame connected to said upper extension arranged to raise said extension and said arms between a lowered baling position and an upper cartridge inserting and removing position, (f) means on said frame for pivoting said upper extension to a first position comprising the baling position of said arms and a tilted position allowing the discharge of a bale rearwardly past the ends of said arms in the open position thereof, (g) an article holding cartridge having pairs of upstanding spaced ribs arranged to confine articles therebetween for baling, (h) said opposed pairs of ribs being substantially parallel with each other and spaced so that said arms can move therebetween whereby articles on said cartridge can be compressed into a bale by movement of said arms to said baling position through the area between said ribs, (i) and ejecting means for rolling a bale rearwardly past the ends of said arms.

13. The apparatus of claim 12 including a transversely extending conveyor associated with said frame for moving said cartridges into a baling position with said arms.

14. The apparatus of claim 13 wherein said conveyor extends laterally on each side of said base frame for carrying loaded cartridges into a baling position with said arms and for carrying emptied cartridges away from said baling position.

15. Apparatus for compressing elongated articles into bales comprising (a) a base frame having forward and rearward ends at opposite sides, (b) an upper extension on said base frame, (c) at least two pairs of front to rear opposed arms supported on said upper extension in pivotal depending spaced relation with said pairs of arms being substantially parallel, (d) means connected to said arms arranged to move opposed arms between open article receiving position and closed article baling position, (e) strap means on said arms operable with said arms for compressing an upper portion of a bale, (f) said strap means having slidable support on at least one of its ends on said arms for movement relative to said arms as the latter open and close, and (g) an article holding cartridge having pairs of upstanding spaced ribs arranged to confine articles therebetween for baling, (h) said opposed pairs of ribs being substantially parallel with each other and spaced so that said arms can move therebetween whereby articles on said cartridge can be compressed into a bale by movement of said arms to said baling position through the area between said ribs.

* * * * *